United States Patent [19]

Kostov

[11] Patent Number: 4,635,817

[45] Date of Patent: Jan. 13, 1987

[54] ICE CUBE DISPENSER

[76] Inventor: Uriy K. Kostov, 5613 Lexington Ave., #105, Los Angeles, Calif. 90038

[21] Appl. No.: 728,045

[22] Filed: Apr. 29, 1985

[51] Int. Cl.[4] ..... G07F 11/00

[52] U.S. Cl. ..... 221/89; 221/91; 249/72; 249/121; 249/119; 249/132; 249/203

[58] Field of Search ..... 221/91, 89, 69; 249/203, 72, 69, 66 R, 121, 132, 119, 71; D15/90; 206/538, 539, 533, 559, 561, 562

[56] References Cited

U.S. PATENT DOCUMENTS

| | | | |
|---|---|---|---|
| 1,879,400 | 9/1932 | Mitchell | 249/71 |
| 2,317,646 | 4/1943 | Sampson | 249/203 |
| 2,435,802 | 2/1948 | Smith | 249/72 |
| 2,456,924 | 12/1948 | Collister | 249/72 |
| 2,874,552 | 2/1959 | Frei | 249/69 |
| 4,261,468 | 4/1981 | Krebs | 221/89 |

*Primary Examiner*—Joseph J. Rolla
*Assistant Examiner*—David H. Bollinger
*Attorney, Agent, or Firm*—Christie, Parker & Hale

[57] ABSTRACT

An apparatus for making ice cubes includes an ice cube tray and an inner grid core. An outer grid core for the apparatus includes sloped sides and a threaded opening at a top of the outer grid core. The outer grid core is wider than the bottom of the core. Dividers are positioned in the ice cube tray and are upright with respect to the ice cube tray. The dividers are inserted into the inner and outer grid cores. A threaded stud is engageable with the threaded opening in the outer grid core.

2 Claims, 18 Drawing Figures

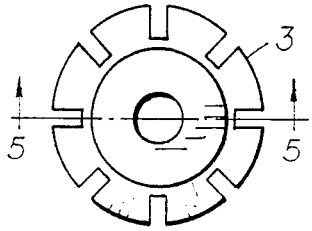
FIG. 3
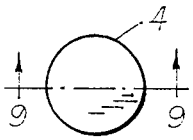
FIG. 7
FIG. 4
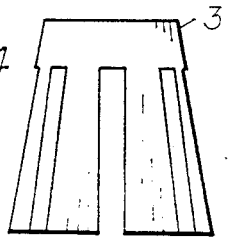
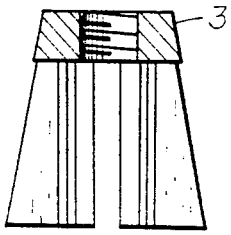
FIG. 5
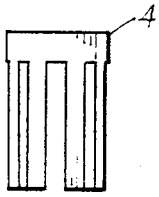
FIG. 8
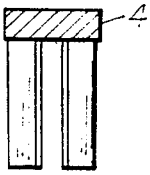
FIG. 9
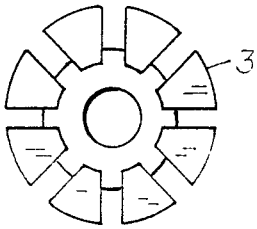
FIG. 6
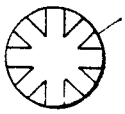
FIG. 10
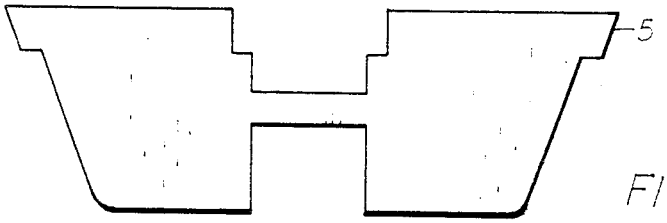
FIG. 11
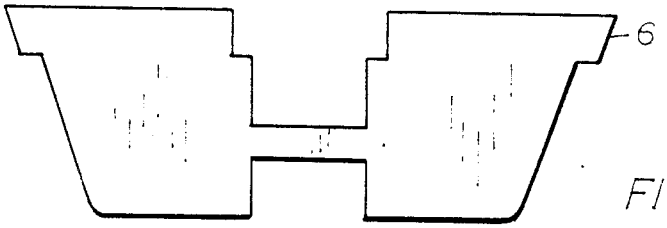
FIG. 12
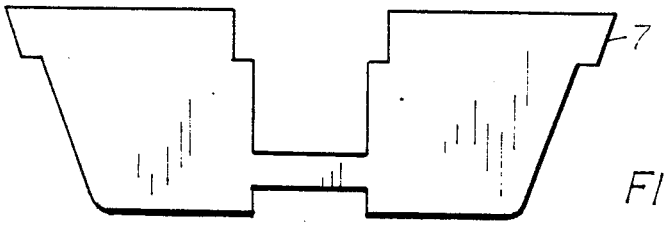
FIG. 13
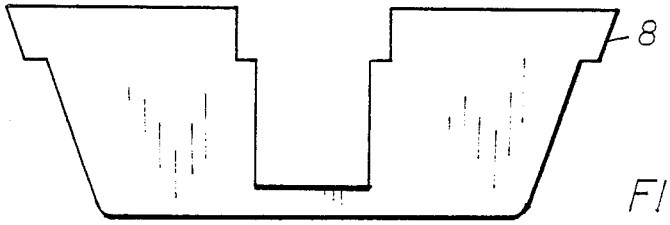
FIG. 14

ICE CUBE DISPENSER

BACKGROUND OF THE INVENTION

1. Field of the Invention

The present invention relates to ice cube trays and more specifically to an ice cube tray through which it is easier to remove the ice cubes.

At the present time most of the ice cube trays are built from two parts: a tray, usually made from metal, and a grid or partition, made from metal or plastic dividers. Release of the ice cubes release is obtained by moving the grid in relation to the tray or by changing the angle between the dividers and one of the sides of the tray. In some cases, both methods are combined. Separation of the ice cubes usually involves large stresses such as those caused by the high ice hardness and the cohesion between the ice and tray and divider walls. Use of leverage systems is quite common, but the forces developed in such systems are still significant and bending or breaking of the grid parts is frequent. The ice release with these trays is sudden, followed usually by spilling some of the ice cubes off the tray.

Plastic trays are becoming more and more popular lately. Release of the ice cubes is achieved by bending or twisting the tray. The disadvantages of these systems are sudden ice braking and spilling of the ice cubes off the tray, shorter life of any plastic product, compared to a metal one of the same kind and less heat conductivity, making the freezing process of the water longer.

SUMMARY OF THE INVENTION

The present invention is oriented to an ice cube tray having dividers positioned in an ice cube tray body. The dividers are upright with respect to the base of the body. An outer core is placed over an inner core and each is positioned with respect to the dividers such that the dividers remain substantially stationary with respect to the inner core. The outer core is sloped with respect to a central axis and is wider at a bottom than at a top of the core. The outer core has a threaded opening in a top of the core. A threaded stud threadably engages the threaded opening.

The ice cube tray may include a dispenser lid with an opening of sufficient size to allow a single ice cube to pass through. The lid is attached to the threaded stud and is rotatable with the stud with respect to the threaded opening. The device allows smooth ice cube release by turning the threaded stud with respect to the threaded core. The sloped core forces the ice cubes upward and away from the walls of the ice cube tray base.

The present invention avoids the disadvantages of the prior devices. Release of the ice cubes is smooth and requires relatively little effort. The dividers in the tray can be set in advance for the desired ice cube size. Additionally, the use of the lid design allows dispensing of the ice cubes in several ways. The ice cubes can be dispensed one at a time or in multiples as desired. For example, where the dispenser lid has a sector-shaped opening and connected to the threaded stud, the opening can be placed over one or more ice cubes so that those ice cubes are dispensed.

In a further aspect of the invention, the inner and outer grid cores constitute a two-piece grid core arrangement capable of accepting different numbers of dividers. This allows the user to choose the desired ice cube sizes.

BRIEF DESCRIPTION OF THE DRAWINGS

The present invention is submitted with a set of drawings in which:

FIG. 3 is a top view of the outer core of the dispenser of the present invention;

FIG. 4 is a side elevation view of the outer core;

FIG. 5 is a side sectional view of the outer core;

FIG. 6 is a bottom plan view of the outer core;

FIG. 7 is a top plan view of the inner core, which is part of the ice cube dispenser;

FIG. 8 is a side elevation view of the inner core;

FIG. 9 is a side sectional view of the inner core;

FIG. 10 is a bottom view of the inner core;

FIGS. 11–14 show side elevation views of dividers for use in the present invention;

in FIG. 16.

DETAILED DESCRIPTION OF THE PREFERRED EMBODIMENTS

Figure 15:
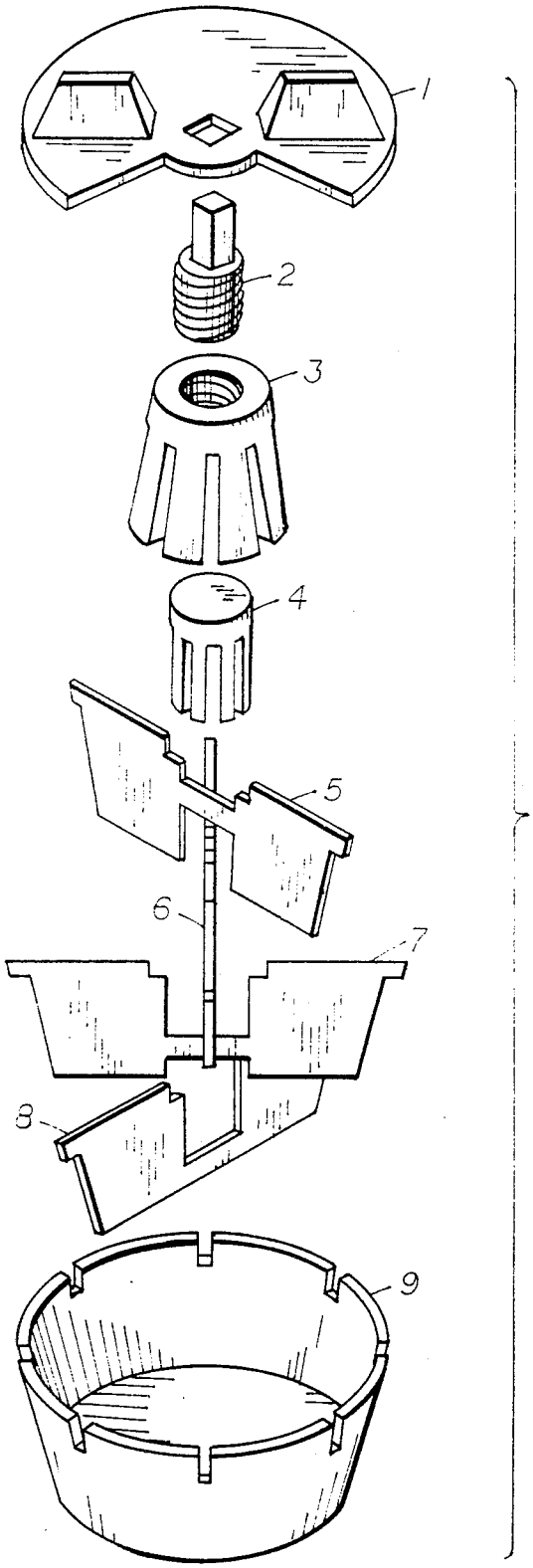
FIG. 15 is an exploded view of the ice cube dispenser of FIG. 1.

Referring to the exploded view of one embodiment of the invention, shown in FIG. 15, a dispenser lid 1 fits over a rectangular post at the top of a, threaded rod 2, an outer core 3 fits over an inner core 4, both of which engage dividers 5,6,7 and 8. The dividers are shown in and corresponding to the dividers shown in FIGS. 11–14. A round tray body 9 accepts the dividers and supports the dividers, the lid, the threaded rod and the outer and inner cores. Each divider has two fins, outlined to fit inside the tray body 9, connected by a bridgelike part in the middle, placed at different levels with respect to each other to allow stacking of said dividers. The tray has eight slots, cut 45° from each other around the rim, to fix the dividers at their positions.

Different views of the inner core 4 are shown in FIG. 7, FIG. 8, FIG. 9 and FIG. 10. It is a solid cylinder with eight grooves at the lower part, cut radially at 45° from each other, deep enough to have room for all four bridgelike portions of the dividers.

FIG. 3, FIG. 4, FIG. 5 and FIG. 6 display the outer core 3, which is a hollow frustum of a cone with eight grooves, corresponding to the ones on the inner core 4 each with a depth a little more than the height of the highest divider. The cylindrical opening at the bottom of the outer core is a little bigger than the size of inner core 4 to assure easy sliding between them, and the hole at the top has a thread, corresponding to the one on the threaded stud 2. The threaded stud 2, shown in sectional view in FIG. 2 and in perspective view in FIG. 15 has a square top end, designed to match the square opening of the dispenser lid 1. The dispenser lid is used for turning the threaded stud 2 into the threaded opening of the outer core 3. The lid 1 has also a segmentlike opening for dispensing ice cubes. The lid has two identical ribs 10 for easy turning in both directions about an axis defined by the threaded stud.

Figure 1:
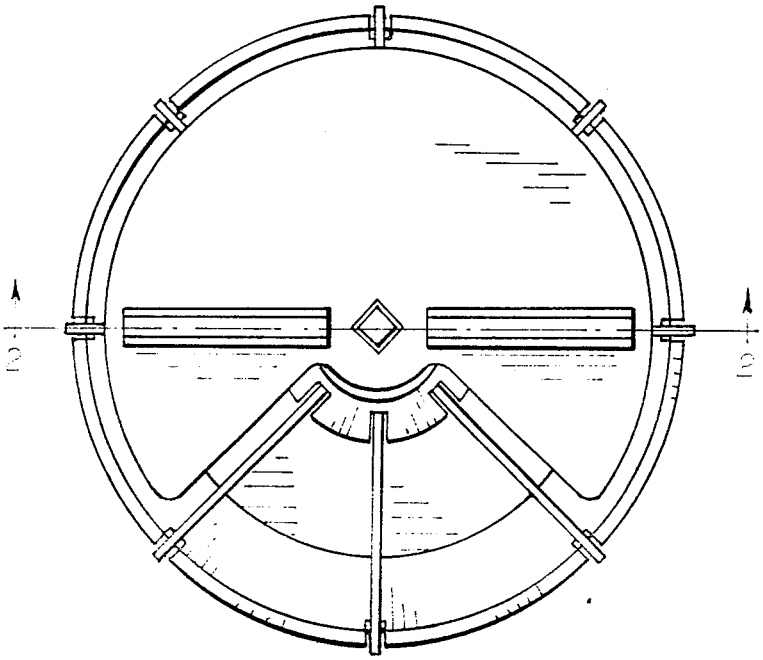
FIG. 1 is a top plan view of the ice cube dispenser according to the present invention.
Figure 2:
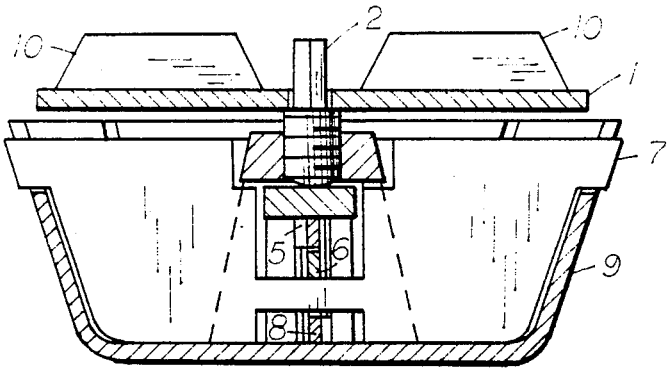
FIG. 2 is a sectional view of the ice cube dispenser taken along lines 2—2 of FIG. 1.

The initial position of the dispenser is shown in FIG. 2. The dividers have been inserted into the inner core grooves and into the rim slots of the tray, the bottom surface of the outer core 3 is on the bottom of the tray body 9 and the threaded stud 2 is screwed into the outer core and is covered by the dispenser lid 1. The tray has to be filled up with water.

To release the ice cubes from the tray, the lid 1 has to be turned clockwise several times. The threaded stud 2 will turn in deeper into outer core 3 and press down the inner core 4, forcing core 3 to move up gradually. The outer core 3, because of its cone shape, wider at the bottom, will pull up the ice and force it to separate from the tray body and the dividers. Some of the ice cubes will be still attached to the outer core wall, but by simply pressing them down with a finger, they will be freed. Further turning of the lid 1 will only lift the core 3 and the ice blocks up, which is not necessary.

The serving of the ice cubes can be performed in two different ways: separately (one piece at a time) by simply turning the lid 1 and fixing its segment opening on top of the desired ice block and tip it over a glass of drink for instance, or simultaneously by removing the lid 1 and turning the tray over an ice bucket for example, allowing all the cubes to drop in at once. To ready the invention for freezing more ice cubes, the tray has to be filled with water and lid 1 replaced, if it has been removed, and turned counterclockwise until the outer core lays on the tray bottom.

Figure 18:
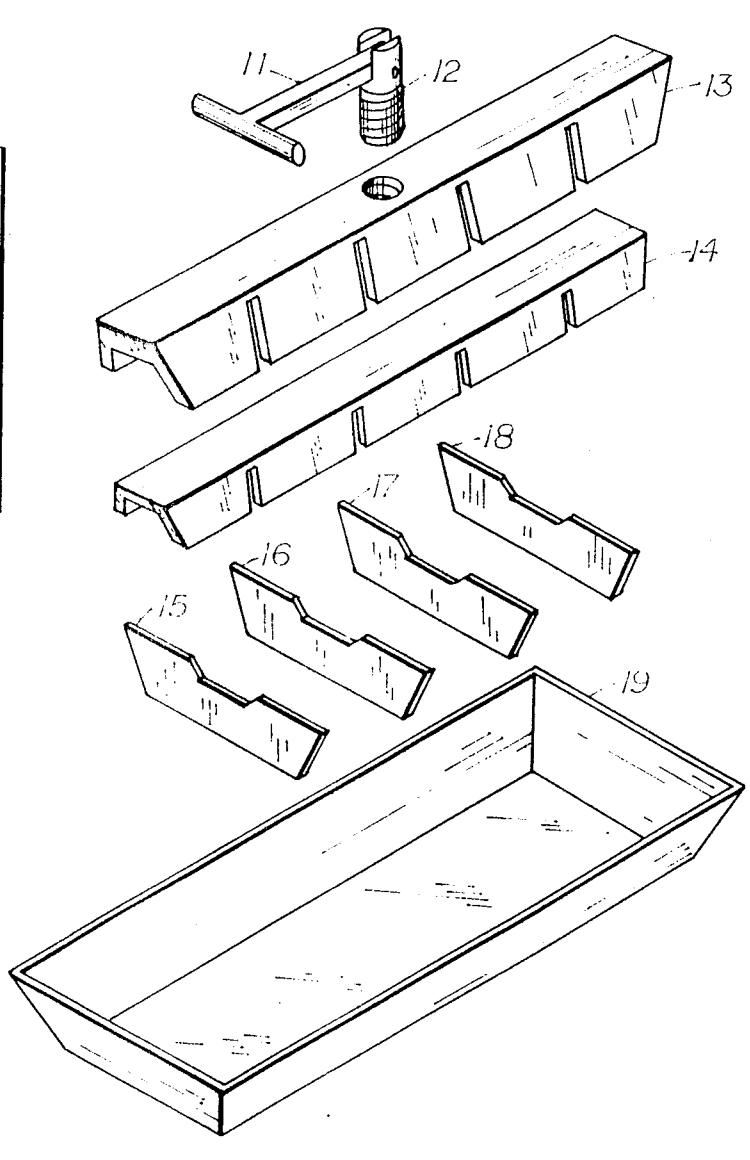
FIG. 18 is an exploded view of the ice tray shown in FIG. 16.
Figure 16:
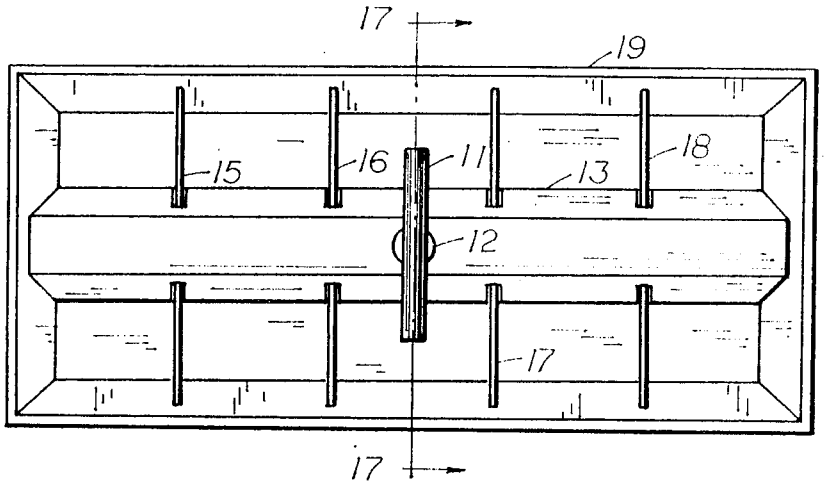
FIG. 16 is a top plan view of a further embodiment of an ice cube tray with two piece grid frame according to the present invention.
Figure 17:
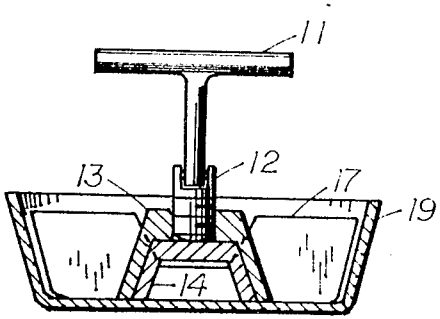
FIG. 17 is a side sectional view of the ice tray taken along lines 17 —17.

An alternate form of the described inner and outer cores, used in a rectangular ice cube tray for easy and gradual ice release is illustrated in FIGS. 16–18 is an exploded view of the device. The apparatus has two frames with inclined side walls and slots in them for fixing the dividers 15,16,17 and 18 in the tray 19. A boltlike stud 12 with a handle 11 for easy operation goes into a threaded opening in the outer frame 13. Turning the handle 11 clockwise will make the stud 12 go deeper pressing down the inner frame 14 and forcing the outer frame 13 up. The inclined side walls of frame 13 will drag the ice up, releasing it from the tray and divider walls gradually and smoothly.

What is claimed is:

1. An apparatus for making ice cubes comprising:

an ice cube tray;

an inner grid core;

an outer grid core comprising sloped sides and a threaded opening at a top of the outer grid core and wider at a bottom of the outer grid core;

dividers positioned in the ice cube tray and upright with respect to the ice cube tray and inserted into the inner and outer grid cores; and a threaded stud engageable with the threaded opening in the outer grid core.

2. The apparatus as claimed in claim 1 further comprising a dispenser lid defining an opening for the ice cube tray for allowing a single ice cube to go through the opening and mountable over the threaded stud for turning the lid in two directions.

* * * * *